US005462110A

United States Patent [19]

Sarver

[11] Patent Number: 5,462,110

[45] Date of Patent: Oct. 31, 1995

[54] CLOSED LOOP AIR-CYCLE HEATING AND COOLING SYSTEM

[76] Inventor: Donald L. Sarver, P.O. Box 323, Cudahy, Wis. 53110

[21] Appl. No.: 175,609

[22] Filed: Dec. 30, 1993

[51] Int. Cl.[6] ..... F25B 29/00; F25D 9/00

[52] U.S. Cl. ..... 165/48.1; 62/277; 62/325; 62/402; 62/513; 62/401

[58] Field of Search ..... 62/401, 402, 325, 62/403, 277, 513; 165/48.1

[56] References Cited

U.S. PATENT DOCUMENTS

| | | | |
|---|---|---|---|
| 2,328,439 | 8/1943 | Esnault-Pelterie | 62/136 |
| 2,466,383 | 4/1949 | Cody | 62/325 |
| 3,141,310 | 7/1964 | Hoffstrom | 62/402 |
| 3,886,765 | 6/1975 | Edwards | 62/402 |
| 4,088,426 | 5/1978 | Edwards | 418/8 |
| 4,198,830 | 4/1980 | Campbell | 62/402 |
| 4,246,963 | 1/1981 | Anderson | 165/166 |
| 4,312,188 | 1/1982 | Swenson et al. | 62/160 |
| 4,326,868 | 4/1982 | Ozu et al. | 62/324 |
| 4,505,128 | 3/1985 | Miller et al. | 62/272 |
| 4,731,102 | 3/1988 | Yoshino | 62/11 |
| 4,936,113 | 1/1990 | Nivens | 62/513 |
| 5,049,044 | 9/1991 | Hirano | 417/310 |
| 5,086,624 | 2/1992 | Matsuoka et al. | 62/160 |
| 5,086,625 | 2/1992 | Momose et al. | 62/175 |
| 5,214,935 | 6/1993 | Brunskill | 62/402 |

FOREIGN PATENT DOCUMENTS

| | | | |
|---|---|---|---|
| 2245920 | 4/1975 | France | 62/401 |
| 0840590 | 6/1981 | U.S.S.R. | 62/402 |

OTHER PUBLICATIONS

Ashrae Handbook, 1984 Systems, p. 10.7 Applied Heat Pump Systems, Copyright 1984.

"Air Cycle Heat Pumps" by Robin MacKay dated Apr. 22, 1993, NoMac Energy Systems, 655 Deep Valley Drive, Suite 205, Rolling Hills Estates, Calif. 90274.

*Primary Examiner*—John K. Ford

*Attorney, Agent, or Firm*—Andrus, Sceales, Starke & Sawall

[57] ABSTRACT

A closed air cycle system for heating and cooling the interior of a structure is provided. The air cycle system includes a compressor to compress and to heat the air. A louver is provided which is movable between a first heating position wherein a heat exchange is effected between the compressed air and a radiator system, and a second cooling position wherein a heat exchange is effected between the compressed air and the air outside the structure. After the initial heat exchange, a second heat exchanger intakes the compressed air. The second heat exchanger is also coupled to the input end of the compressor to provide air to the compressor. The second heat exchanger effects a heat exchange between the compressed air and the air provided to the compressor. After exiting the second heat exchanger, the compressed air rotates a turbine so as to generate power to partially power the compressor. As a result of driving the turbine, the air is decompressed. The air is provided to a third heat exchanger which includes a second louver. The second louver is movable between a first heating position wherein the third heat exchanger effects the heat exchange between the decompressed air and the air outside of the structure, and a second cooling position wherein the third heat exchanger effects the heat exchange between the compressed air and the interior of the structure. The decompressed air flows into a third heat exchanger to provide the air for the compressor and the cycle is repeated.

6 Claims, 2 Drawing Sheets

CLOSED LOOP AIR-CYCLE HEATING AND COOLING SYSTEM

BACKGROUND OF THE INVENTION

This invention relates to heat pumps, and in particular, to a closed air cycle system for heating and cooling the interior of a structure.

Heat pumps have long been known in the art. While most present day heat pumps use freon, an environmentally unfriendly composition, early theories regarding the heat pump contemplated the use of air in a closed system. In an air cycle heat pump, an electric motor drives an air compressor which in turn is connected to a turbine. Air is taken into the compressor and compressed such that the air increases in temperature and pressure. In order to heat the interior of a structure, the air is passed through a heat exchanger in order to effect a heat exchange between the compressed air and the room to be heated. While the compressed air loses some of its heat in the exchange, the compressed air remains warm and maintains its pressure. The warm air is passed through a turbine such that the air is expanded and hence cooled substantially. The energy generated by the turbine may be used to partially operate the electric motor of the compressor. The cooled expanded air then passes through a heat exchanger so as to effect a heat exchange between the cool air and the outside air so as to partially reheat the expanded air. The expanded air is taken back into the compressor where the cycle is repeated.

In order to cool the interior of a structure, the heated, compressed air is passed through a heat exchanger so as to effect a heat exchange between the compressed air and the outside air. In this manner, a portion of the heat is dissipated. The warm, compressed air is then passed through the turbine where it is expanded and cooled. The cool, expanded air is passed through a second heat exchanger so as to effect a heat exchange between the cool, expanded air and the air within the interior of the structure, thereby cooling the interior.

While the closed air cycle heat pump system is functional, the system is inefficient. During the heating cycle, the compressor takes in the very cool air which has just passed through the second heat exchanger. As a result, the compressor must do considerable work to compress the air to a temperature which can heat the interior of a structure. Similarly, during the cooling cycle, the compressor must do considerable work to compress the very cool air to a sufficient pressure and temperature to effect the heat exchange between the compressed air and the air outside of the structure.

It is therefore a primary object and feature of this invention to provide a closed air cycle system for heating and cooling the interior of a structure which is highly efficient and economical.

It is a further object and feature of this invention to provide a closed air cycle system for heating and cooling the interior of a structure which is environmentally friendly.

It is a still further object and feature of this invention to provide a closed air cycle system for heating and cooling the interior of a structure which is easy to install and cost effective.

SUMMARY OF THE INVENTION

In accordance with the invention, a closed air cycle system for heating and cooling the interior of a structure is provided. The system includes a compressor to compress and to heat the air cycled within the system. The compressor is run by an electrical motor.

A first heat exchanger is coupled to an outlet end of the compressor so as to intake the warm compressed air. A first louver is interconnected to the first heat exchanger. When the closed air cycle system is in the heating cycle, the first louver is positioned such that the first heat exchanger effects the heat exchange between the warm, compressed air and a radiator system. When the closed air cycle system is in the cooling cycle, the first louver is positioned so that the first heat exchanger effects the heat exchange between the compressed air and the air outside of the structure.

A second heat exchanger is coupled to the outlet end of the first heat exchanger so as to intake the compressed air. In addition, the second heat exchanger is coupled to the input end of the compressor so as to provide the air to be compressed. The second heat exchanger effects a heat exchange between the compressed air and the air to be provided to the compressor. As a result, the air provided to the compressor is warmed before entering the compressor such that the compressor does less work to compress the air than required in previous closed, air cycle heat pumps. The system is thereby more efficient than previous closed, air cycle heat pumps.

A turbine is interconnected to the second heat exchanger to intake the compressed air. The energy of the compressed air rotates the turbine and generates energy to partially power the compressor. The air, now decompressed and hence cooled, passes through a third exchanger which is coupled to the input of the second heat exchanger, and the decompressed air is provided to the compressor. A second louver is interconnected to the third heat exchanger.

During the heating cycle, the second louver is positioned such that the third heat exchanger effects the heat exchange between the cool, decompressed air and the air outside of the structure in order to partially rewarm the decompressed air before the air re-enters the second heat exchanger. During the cooling cycle, the second louver is positioned such that the third heat exchanger effects the heat exchange between the cool, decompressed air and the interior of the structure in order to cool the interior.

In order to increase efficiency, a heat jacket may be placed over the compressor in order to recover part of the waste heat from the electric motor and compressor. In addition, a defrost system may be provided for melting any accumulation of frost in the second and third heat exchangers. The second and third heat exchangers may be coupled to a sewer system to allow the melted frost to drain.

BRIEF DESCRIPTION OF THE DRAWING

The drawings illustrate the best mode presently contemplated for carrying out the invention.

In the drawings.

DETAILED DESCRIPTION OF THE PREFERRED EMBODIMENT

Figure 1:
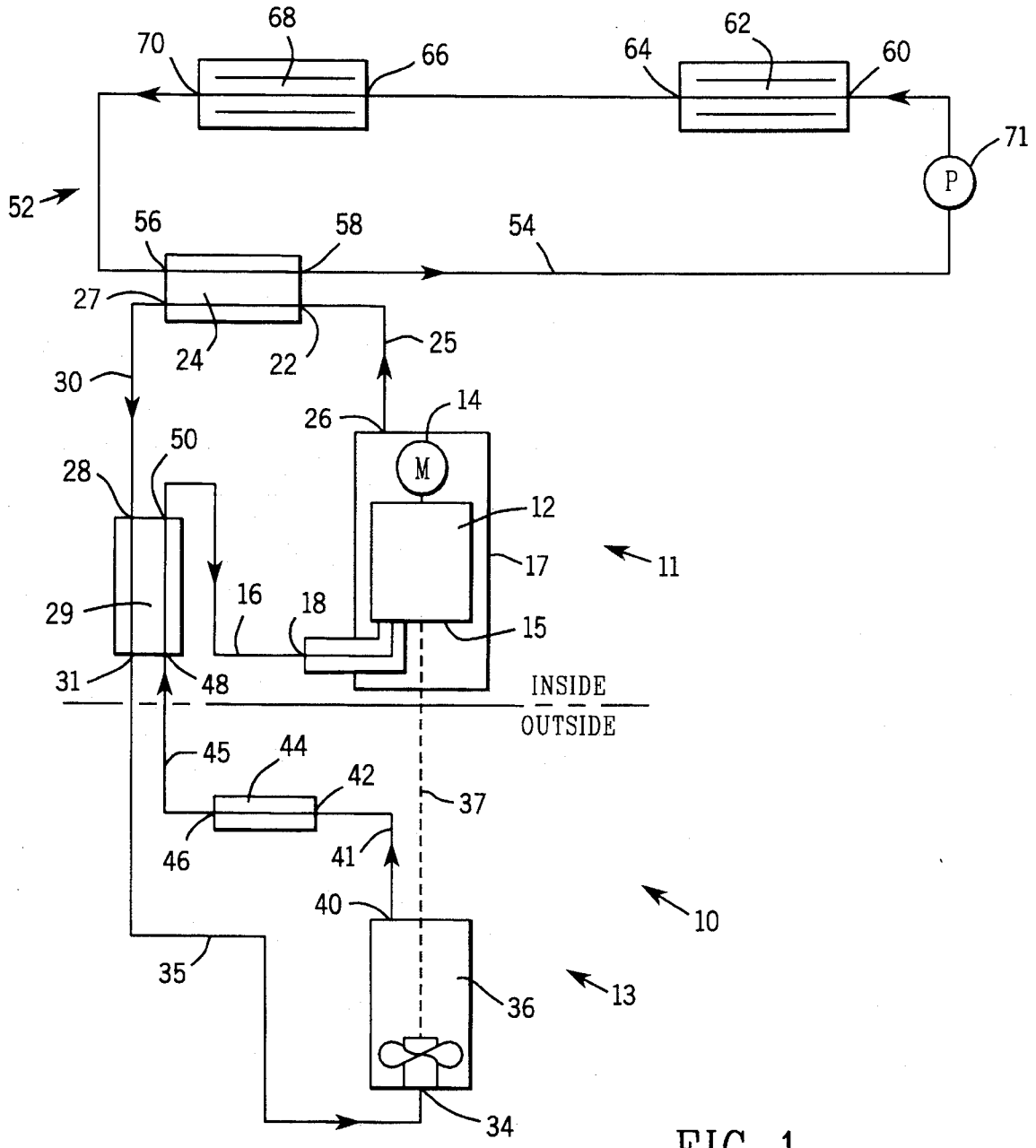
FIG. 1 is a block diagram of a closed air cycle system for heating the interior of a structure in accordance with the present invention.

A closed air cycle system, FIG. 1, for heating the interior of a structure is generally designated by the reference numeral 10. The system 10 is defined by a first interior section 11 within the structure and a second exterior section 13 outside the structure. The interior section 11 includes a housing 15 for a compressor 12 driven by an electric motor 14. The compressor 12 takes in air from line 16 through an input 18 in housing 15. A heat jacket 17 may be placed about compressor 12 and motor 14 in order to prevent heat from dissipating. An input 22 of a first heat exchanger 24 is coupled by line 25 to outlet 26 of housing 15 to receive warm, compressed air from compressor 12.

The compressed air flows through first heat exchanger 24 and exits the heat exchanger through outlet 27. An input 28 of a second heat exchanger 29 is coupled by line 30 to the output 27 of the first heat exchanger 24. The compressed air flows through second heat exchanger 29 and out of the heat exchanger through outlet 31.

The second exterior section 13 of the closed air cycle system 10 includes a reaction turbine 36 and a third heat exchanger 44. The turbine 36 has an input end 34 coupled by line 35 to the output 31 of the second heat exchanger 29 for receiving the compressed air. The energy of the compressed air rotates the reaction turbine 36 and generates power. Power line 37 interconnects the turbine 36 and the compressor 12. The power generated by rotation of turbine 36 is used to partially power the compressor 12.

As the compressed air rotates the turbine 36, the air loses its energy and is decompressed, and hence cooled. The cold, decompressed air flows out the turbine 36 through the output 40 which is coupled by line 41 to the input 42 of third heat exchanger 44. The third heat exchanger 44 includes an output 46 coupled by line 45 to a second input 48 on the second heat exchanger 29.

The decompressed air flows through a second output 50 in second heat exchanger 29 and into line 16 where the air is once again taken into input 18 of housing 15 and the cycle is repeated.

A radiator system 52 is also provided. The radiator system 52 includes a water line containing water which flows through a second input 56 in first heat exchanger 24. The water flows out a second output 58 in first heat exchanger 24 and through line 54 to the input 60 of a first radiator 62. The output 64 of first radiator 62 is coupled to the input 66 of a second radiator 68. The water flows through the output 70 of second radiator 68 and re-enters the first heat exchanger 24. The cycle is then repeated. A pump 71 is provided to facilitate the flow of water through water line 54. As described, all of the components of the radiator system 52 are coupled together by water line 54.

In operation, cool, decompressed inside air from line 16 is taken into the compressor 12 and compressed such that the air increases in temperature and in pressure. The warm, compressed air flows through line 25 into the input 22 of first heat exchanger 24. In first heat exchanger 24, a heat exchange is effected between the warm, compressed air and the water in water line 54. The water, now warmed from the heat exchange with the compressed air, is pumped by pump 71 from the second output 58 of heat exchanger 24 and into input 60 of first radiator 62. As the warm water flows through radiator 62, a heat exchange is effectuated between the radiator 62 and air within the interior of the structure in order to heat the interior of the structure. The water exits output 64 of the first radiator 62 and enters input 66 the second radiator 68. Once again, a heat exchange is effectuated to heat air within the interior of the structure. This time, the heat exchange is effected between the second radiator 68 and the interior of the structure.

As the water leaves the second radiator 68 through output 70, the temperature of the water is decreased due to the previous heat exchanges with the interior air. In order to reheat the water, the water is once again passed through the first heat exchanger 24 and the cycle is repeated.

After the heat exchange with the water, the compressed air flows out the output 27 of heat exchanger 24 and into the first input 28 of the second heat exchanger 29. The compressed air flows out the output 31 of the second heat exchanger 29 and into the input end 34 of turbine 36. As previously described, the turbine 36 is located outside of the structure to be heated.

The compressed air passes through the turbine 36 and the energy of the air rotates the turbine so that the air is expanded, and hence, cooled substantially. As is known, the temperature of the expanded air will be cooler then the air outside the structure. Rotation of the turbine generates energy to partially power the compressor 12.

The expanded air leaves turbine 36 through outlet 40 and enters third heat exchanger 44. Third heat exchanger 44 effects a heat exchange between the very cold, expanded air and the air outside the structure so as to partially reheat the expanded air. This partially reheated air is provided to the second heat exchanger 29. The second heat exchanger 29 effects the heat exchange between the warm, compressed air from the first heat exchanger 24 and the decompressed air received from third heat exchanger 44 so as to increase the temperature of the decompressed air. The decompressed air in line 16 is taken back into compressor 12 through input 18 and the cycle is repeated.

Because the decompressed air has been partially reheated by the heat exchanges effectuated by the second 29 and the third 44 heat exchangers, the compressor 12 has to do less work to compress the air to a temperature sufficient to heat the water in water line 54. Since the compressor does less work, the system 10 is more efficient and more economical to operate than previous heat exchanger systems.

Figure 2:
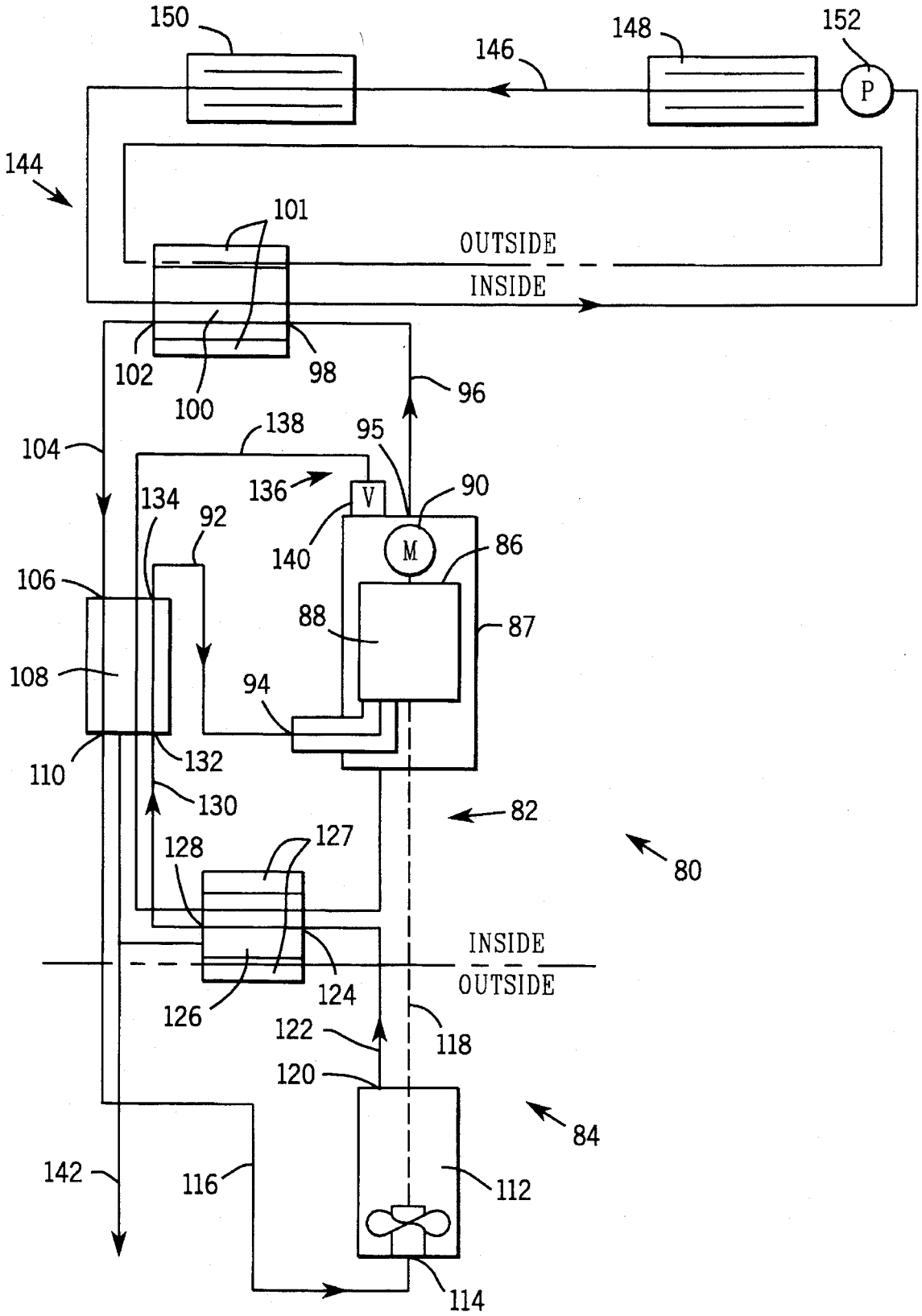
FIG. 2 is a block diagram of a closed air cycle system for heating and cooling the interior of a structure in accordance with the present invention.

Referring to FIG. 2, a closed air cycle system 80 is provided for heating and cooling the interior of a structure. The system 80 is defined by a first interior section 82 and a second exterior section 84. The interior section 82 includes a housing 86 having a compressor 88 driven by an electric motor 90. The compressor 88 takes in air from line 92 through an input 94 in housing 86 in order to compress and to heat the air. The warm, compressed air flows from output 95 to an input 98 of a first heat exchanger 100 in line 96.

The first heat exchanger 100 includes a louver 101 movable between a first cooling position when the system is in the cooling cycle, and a second heating position when the system is in the heating cycle. When in the cooling cycle, the louver 101 is positioned such that the first heat exchanger 100 effects a heat exchange between the warm, compressed air and the air outside of the structure. When in the heating cycle, the louver 101 is positioned such that the first heat exchanger 100 effects a heat exchange between the warm, compressed air and a radiator system, described infra.

After flowing through heat exchanger 100, the warm, compressed air exits through outlet 102 into line 104. Input 106 of a second heat exchanger 108 receives the air from line 104. The air flows through the second heat exchanger 108 and is outputted at outlet 110.

The second exterior section 84 of the closed air cycle system 80 includes a reaction turbine 112. The reaction turbine 112 has an input 114 coupled by line 116 to the output 110 of the second heat exchanger 108. The warm, compressed air rotates the reaction turbine 112 and generates power which is transmitted on power line 118 to partially power compressor 88.

As the compressed air rotates the turbine 112, the air losses its energy and is decompressed, and hence cooled. As is known, the temperature of the decompressed air will be cooler than the air outside of the structure. The cold, decompressed air exits turbine 112 through output 120 and flows through line 122 to the input 124 of a third heat exchanger 126. The third heat exchanger 126 includes a louver 127 movable between a first cooling position when the system is in the cooling cycle, and a second heating position when the system is in a heating cycle. When in the cooling cycle, the louver 127 is positioned such that the third heat exchanger 126 effects a heat exchange between the cold, decompressed air received at input 124 and the interior of the structure. When in the heating cycle, the louver 127 is positioned such that the third heat exchanger 126 effects a heat exchange between the decompressed air received at input 124 and the air outside of the structure.

After the air flows through third heat exchanger 126, the air exits the third heat exchanger 126 through output 128 and is transmitted along line 130 to a second input 132 in the second heat exchanger 108. The decompressed air flows through the second heat exchanger 108 and output 134 into line 92. The air in line 92 is taken back into the compressor 88 and the cycle is repeated.

The first interior section 82 of the system 80 also includes a defrost system 136. The defrost system 136 includes a water line 138 which flows from compressor 88 through the second 108 and the third 126 heat exchangers and back into the compressor. Valve 140 is opened when the system 80 is in the heating cycle so as to allow water, heated by the warm, compressed air, to flow through the second 108 and the third 126 heat exchangers in order to prevent the build up of frost. Line 142 connects the second heat exchanger 108 and the third heat exchanger 126 to a sewer system (not pictured) in order to allow the melted frost to drain.

FIG. 2 shows a radiator system 144 for use in conjunction with the closed air cycle system 80 of the present invention. The radiator system includes a water line 146 which passes through heat exchanger 100 and a pair of radiators 148 and 150. When the system 80 is in the heating cycle, pump 152 pumps water through water line 146. A heat exchange in the first heat exchanger 100 between the warm, compressed air and the water in water line 146 heats the water. The water is then pumped through radiators 148 and 150 in order to heat the interior of the structure.

In operation, the user selects whether the system will be operated in the heating or the cooling cycle so as to position the louvers 101, 127 in the first and the third heat exchangers and to turn pump 152 on or off. The cool, decompressed air from line 92 is taken into compressor 88 and compressed such that the temperature and the pressure of the air increases. The warm, compressed air flows through line 96 and into the input 98 of the first heat exchanger 100. In the heating cycle, the first heat exchanger effects a heat exchange between the warm, compressed air and the water flowing in water line 146. The water, now warmed from the heat exchange with the compressed air, is pumped through radiators 148 and 150 in order to effect a heat exchange between the radiators 148, 150 and air within the interior of the structure in order to heat the interior of the structure. As the water leaves the second radiator 150, the temperature of the water is decreased due to the heat exchange with air within the interior of the structure. In order to reheat the water, the water is once again passed through the first heat exchanger 100 and the cycle is repeated.

After the heat exchange with the water, the warm, compressed air flows out the output 102 of heat exchanger 100 and into the input 106 of the second heat exchanger 108. As described infra, the second heat exchanger 108 will effectuate a heat exchange between the warm, compressed air flowing therethrough and the decompressed air supplied to compressor 88.

The compressed air flows from the second heat exchanger 108 to turbine 112. The turbine 112, as previously described, is located outside the structure to be heated. The compressed air passes through the turbine and the energy of the air rotates the turbine such that the air is expanded and hence, cooled substantially. As previously described, the temperature of the expanded air will be cooler than the air outside of the structure.

From turbine 112, the cooled, expanded air enters the third heat exchanger 126. When the system is in the cooling cycle, the third heat exchanger effectuates a heat exchange between the interior of the structure and the cool, expanded air. This, in turn, cools the interior of the structure.

On the other hand, when the system is in the heating cycle, the third heat exchanger 126 effectuates a heat exchange between the cool, expanded air and the air outside of the structure. Since the temperature of the air outside the structure is higher than the temperature of the cooled, expanded air, the expanded air will increase in temperature.

The expanded air is then passed through the second heat exchanger 108. The second heat exchanger 108 effectuates a heat exchange between the warm, compressed air received at input 106 and the expanded air received at input 132 so as to partially reheat the expanded air. This partially reheated air is taken back into compressor 88 through line 92 and the cycle is repeated.

Because decompressed air has been partially reheated by the heat exchange effectuated by the second 108 and the third 126 heat exchangers, the compressor 88 has to do less work to compress the air. In the heating cycle, the compressor does less work to compress the air to a temperature sufficient to heat the water flowing in water line 146. In the cooling cycle, the compressor has to do less work to compress the air to a pressure and a temperature to effect the heat exchange between the compressor air and the air outside of the structure. As a result, the system 80 is more efficient and more economical to operate.

It can be seen through the description of this invention that various alternatives and embodiments are possible without deviating from the scope and spirit of this invention.

We claim:

1. A closed air cycle system for heating and cooling air within the interior of a structure having a liquid radiator system, comprising:

a compressor to compress air;

a first heat exchanger coupled to the compressor so as to intake compressed air therefrom;

a first louver interconnected to the first heat exchanger, the first louver movable between a first heating position wherein the first heat exchanger effects a heat exchange between the compressed air and the liquid radiator system within the interior of the structure and a second cooling position wherein the first heat exchanger effects a heat exchange between the compressed air and outside air;

a second heat exchanger coupled to the first heat exchanger so as to intake the compressed air and coupled to the compressor so as to provide air to the compressor, the second heat exchanger effecting a heat exchange between the compressed air and the air provided to the compressor;

a turbine coupled to the first heat exchanger to intake the compressed air, the turbine rotating by energy of the compressed air so as to generate energy to partially power the compressor and to decompress the compressed air; and a third heat exchanger coupled to the turbine so as to intake the decompressed air and coupled to the first heat exchanger so as to provide the air for the compressor;

a second louver interconnected to the third heat exchanger, the second louver movable between a first heating position wherein the third heat exchanger effects a heat exchange between the decompressed air and outside air and a second cooling position wherein the third heat exchanger effects a heat exchange between the compressed air and the interior of the structure.

2. The closed air cycle system of claim 1 further comprising a defrost system for melting frost in the second and the third heat exchangers.

3. The closed air cycle system of claim 2 wherein the second heat exchanger includes a drain to discharge melted frost therefrom.

4. The closed air cycle system of claim 2 wherein the third heat exchanger includes a drain to discharge melted frost therefrom.

5. The closed air cycle system of claim 1 further comprising an electric motor to partially power the compressor and a heat jacket placed over the compressor and the electric motor.

6. A closed air cycle system for heating and cooling air within the interior of a structure having a liquid radiator system, comprising:

a compressor to compress air;

a first heat exchanger coupled to the compressor so as to intake compressed air therefrom;

a first louver interconnected to the first heat exchanger, the first louver movable between a first heating position wherein the first heat exchanger effects a heat exchange between the compressed air and liquid circulating in the liquid radiator system so as to heat the air within the interior of the structure and a second cooling position wherein the first heat exchanger effects a heat exchange between the compressed air and outside air;

a second heat exchanger coupled to the first heat exchanger so as to intake the compressed air and coupled to the compressor so as to provide air to the compressor, the second heat exchanger effecting a heat exchange between the compressed air and the air provided to the compressor;

a turbine coupled to the first heat exchanger to intake the compressed air, the turbine rotating by energy of the compressed air so as to generate energy to partially power the compressor and to decompress the compressed air; and a third heat exchanger coupled to the turbine so as to intake the decompressed air and coupled to the first heat exchanger so as to provide the air for the compressor;

a second louver interconnected to the third heat exchanger, the second louver movable between a first heating position wherein the third heat exchanger effects a heat exchange between the decompressed air and outside air and a second cooling position wherein the third heat exchanger effects a heat exchange between the compressed air and the interior of the structure.

* * * * *